United States Patent [19]

Bruml et al.

[11] Patent Number: 4,947,993

[45] Date of Patent: Aug. 14, 1990

[54] CONTAINER

[75] Inventors: Norm Bruml, Montvale; Douglas Graham, Boonton, both of N.J.

[73] Assignee: Kathryn Nicolosi, Moorestown, N.J.

[21] Appl. No.: 387,753

[22] Filed: Jul. 31, 1989

[51] Int. Cl.[5] ..... A45C 11/20

[52] U.S. Cl. ..... 206/551; 206/45.32; 206/45.34; 229/1.5 C; 229/2.5 R

[58] Field of Search ..... 206/45.34, 45.32, 467, 206/468, 470, 551, 216, 38; 229/1.5 C, 2.5 R; 220/4 B, 4 E, 306

[56] References Cited

U.S. PATENT DOCUMENTS

| | | | |
|---|---|---|---|
| 2,246,695 | 6/1941 | Phillips | 206/45.32 |
| 2,584,379 | 2/1952 | Chmielewski | 206/551 |
| 2,885,135 | 5/1959 | Friday | 229/2.5 R |
| 3,303,964 | 2/1967 | Luker | 229/2.5 R |
| 3,595,428 | 7/1971 | Mounts | 229/2.5 R |
| 3,620,403 | 11/1971 | Rump | 206/551 |
| 3,620,411 | 11/1971 | Rump | 206/551 |
| 3,690,902 | 9/1972 | Dahl | 206/45.32 |
| 3,722,779 | 3/1973 | Chang | 229/1.5 C |
| 3,815,736 | 6/1974 | Sedlak | 229/2.5 |
| 3,861,433 | 1/1975 | Schier et al. | 220/306 |
| 3,863,833 | 2/1975 | Swett et al. | 220/4 B |
| 3,955,742 | 5/1976 | Marshall et al. | 229/1.5 C |
| 4,124,141 | 11/1978 | Armentrout et al. | 220/306 |
| 4,206,845 | 6/1980 | Christian | 229/2.5 R |
| 4,244,470 | 1/1981 | Burnham | 229/2.5 R |
| 4,375,862 | 3/1983 | Kurinsky et al. | 206/45.32 |
| 4,466,552 | 8/1984 | Butterworth et al. | 220/306 |
| 4,741,452 | 5/1988 | Holzkopf | 206/45.32 |
| 4,747,510 | 5/1988 | Mack | 220/306 |
| 4,753,351 | 6/1988 | Guillin | 229/2.5 R |
| 4,754,874 | 7/1988 | Haney | 206/306 |
| 4,784,273 | 11/1988 | Niemetz | 206/551 |
| 4,811,846 | 3/1989 | Bottega | 206/551 |
| 4,819,824 | 4/1989 | Longbottom et al. | 220/306 |
| 4,826,039 | 5/1989 | Landis | 220/306 |

FOREIGN PATENT DOCUMENTS

| | | | |
|---|---|---|---|
| 33266 | 8/1981 | European Pat. Off. | 220/306 |
| 1264811 | 2/1972 | United Kingdom | 229/2.5 R |

*Primary Examiner*—David I. Fidei

*Attorney, Agent, or Firm*—Eugene E. Renz, Jr.

[57] ABSTRACT

A container device for transporting single servings of goods. A base has a central depression shaped to hold the goods and is circumvented by side walls conforming to the shape. This provides an upwardly facing primary shoulder region. The walls further include an exteriorly projecting first shoulder disposed below the primary shoulder, and a flared radially outwardly directed terminal edge having a second outwardly projecting shoulder. A cover has a top surface and side walls shaped to conform to the shape of the base. The side walls have an interiorly projecting first shoulder and terminate in a flared radially outwardly directed terminal edge. The interiorly projecting shoulder and terminal edge of the wall are aligned to interface with the first projecting shoulder and second projecting shoulder respectively of the base. The cover side walls have an upper portion extending generally vertically above the primary shoulder region of the base to the top surface of the cover for sufficient distance to accommodate the goods. The upper portion has a plurality of vertically upstanding rigidifying pyramidal shaped sections, each having an upper end terminating adjacent the top surface and has a lower end with an inwardly projecting ledge aligned to abut on the primary shoulder to restrict inward or downward movement of the cover toward the goods.

5 Claims, 3 Drawing Sheets

CONTAINER

FIELD OF THE INVENTION

The present invention relates to containers useful for transporting and displaying single servings of goods such as cakes, pies and the like. The device permits shipping and displaying of these single servings while protecting and preserving the integrity of the goods. The device also allows the product to be displayed in stores, offering the convenience of a complete single service device having an eating utensil enclosed.

BACKGROUND OF THE INVENTION

Packages for transporting and displaying single servings of goods such as pieces of cake and slices of pie appear at first glance to be simple containers.

In actuality, containing devices for transporting and displaying single servings of goods need to be very inexpensive, involve no operating parts, and be extremely simple and easy to use. They should be easy to price and/or label. They should be crush proof and prevent lateral movement. They should be clear, attractive display cartons. In particular with cake slices, it is important to preserve the integrity of the sharp edge or point of the slice. It is essential that the food being transported be held firmly in place and yet it is necessary that the container not contact the goods anywhere that is visible to the consumer.

In addition, a container device for transporting and displaying single servings of goods must be able to keep the goods fresh and avoid spoilage. It should be easy to open so that the piece of cake does not end up on the floor or in one's lap. Once the top has been removed, the goods should be totally accessible for consumption. Yet it should also be possible to replace the cover in the event that the customer decides to finish the dessert later, perhaps because the portion is too large.

At the present time, there is no acceptable product on the market which is totally suitable for use as a container device for transporting and displaying single servings of goods such as pieces of cake and slices of pie.

SUMMARY OF THE INVENTION

It has now been discovered that the above and other objects of the present invention may be accomplished in the following device. The device includes a base and a cover.

The base has a central depression which is shaped to hold the goods and is circumvented by side walls conforming to the shape and providing an upwardly facing primary shoulder region. The walls further includes an exteriorly projecting first shoulder disposed below the primary shoulder and a flared radially outwardly directed terminal edge defining a second outwardly projecting shoulder.

The cover has a top surface and side walls shaped to conform to the shape of the base. The side walls have an interiorly projecting first shoulder and a flared radially outwardly directed terminal edge. The interiorly projecting shoulder and terminal edge of the wall are aligned to interface with the first projecting shoulder and second projecting shoulder respectively on the base.

The cover side walls have an upper portion which is extending generally vertically above the primary shoulder region of the base to the top surface of the cover for a distance which is sufficient to accommodate the goods. The upper portion has a plurality of vertically upstanding rigidifying means. Each rigidifying means has an upper end terminating adjacent the top surface. Also, it has a lower end with an inwardly projecting ledge which is aligned to abut on the primary shoulder of the base to restrict inward and/or downward movement of the cover when pressure on top of the cover is exerted.

In a preferred embodiment is the inclusion of an inward recess which is sized to accommodate a utensil such as a spoon or fork. One rigidifying means may be provided on the cover to include a lower end extending inwardly over the recess where the utensil is placed, so that the lower end is aligned to abut a portion of the utensil. A tab may be located on the base to assist in separating the base from the cover to permit easy and quick access to the contents can be achieved.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 3:
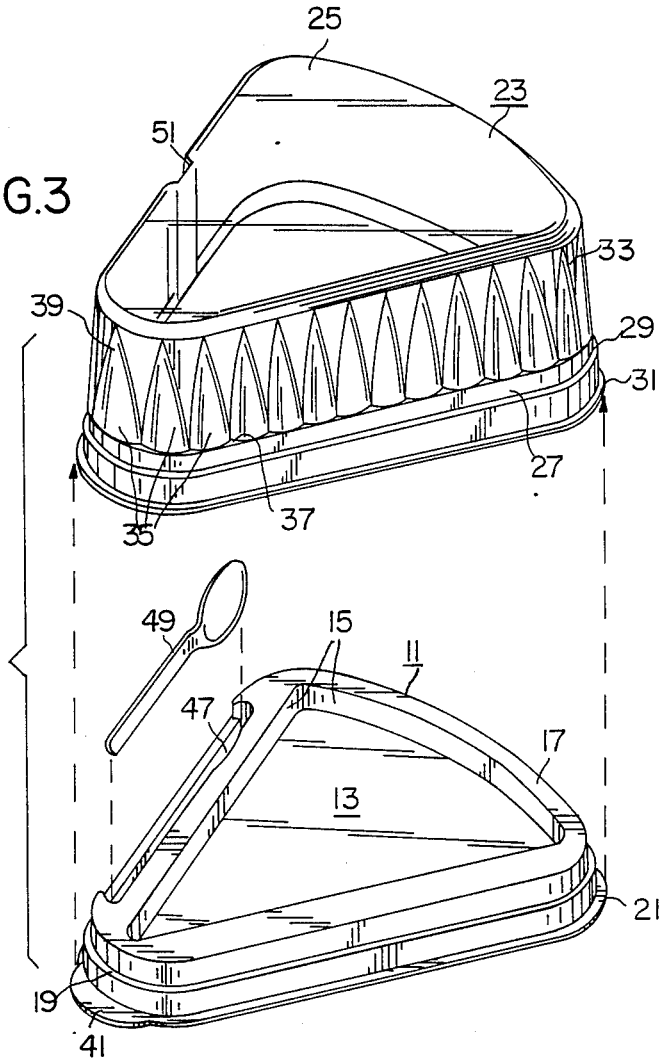
FIG. 3 is an exploded perspective view of the container shown in FIGS. 1 and 2, showing an opaque base having a recessed portion into which a slice of pie or cake is placed, a retaining slot into which an eating utensil is inserted and a peripherally conforming, closely fitting, transparent closure member.

As shown in the figures, the container device for transporting single servings of goods is shown generally by the reference numeral 10. The device includes a base portion 11 which has a central depression 13 which is shaped to hold the goods. In the embodiment shown herein, the central depression 13 is shaped to hold a slice of pie or a piece of cake. Side walls 15 circumvent the central depression and conform to its shape. Side walls 15 are sufficiently high to give stability to the serving of goods which is placed in the depression 13. The side walls 15 provide an upward facing primary shoulder region 17 which is best seen in FIG. 3. Walls 15 further include an exteriorly projecting first shoulder 19 which is disposed below the primary shoulder 17. Also on wall 15 is a flared radially outwardly directed terminal edge 21 which defines a second outwardly projecting shoulder.

The cover 23 has a top surface 25 which is clear and flat, displaying the goods which are contained inside the container device. The cover 23 has side walls 27 which include a first shoulder 29 which is inwardly projecting. Side wall 27 also has a flared radially outwardly directed terminal edge 31. In the exploded perspective view shown in FIG. 3, the radially projecting edge 31 of the cover 23 is aligned to interface with the second or flared radially outwardly directed terminal edge 21 of the base 11. Similarly, the first inwardly projecting shoulder 29 of the cover 23 is aligned to interface with the exteriorly projecting first shoulder 19 of the base 11. These two shoulder alignments 19–29 and 21–31 provide a stability and integrity of the junction of the base 11 and cover 23.

The cover side walls 27 have an upper portion 33 extending generally vertically above the primary shoulder region 17 of the base 11 for sufficient distance to accommodate the goods which are held in the central depression 13. The upper portion 33 has a plurality of vertically upstanding rigidifying means 35. Each of these rigidifying means 35 has a lower end with an inwardly projecting ledge 37 which is aligned to abut on the primary shoulder 17 of base 11. These rigidifying means 35 also terminate in an upper end 39 adjacent the top surface 25 of the cover 23.

A tab 41 is located on the base 11 as shown in FIG. 3 to permit easy separation of the cover from the base 11 without disturbing the goods contained in the central depression 13.

Figure 1:
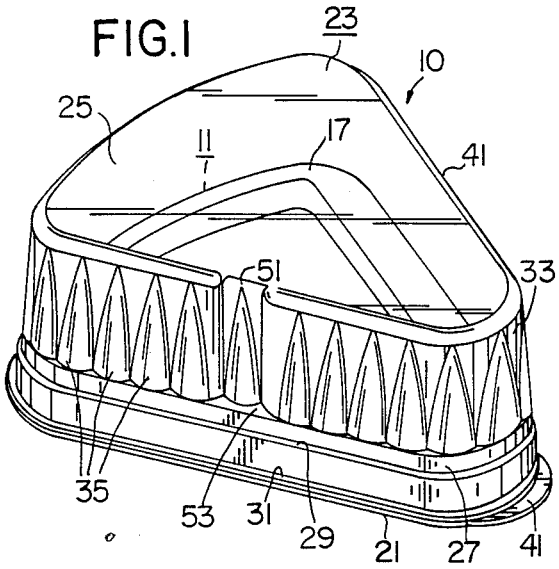
FIG. 1 is a perspective view of a pie or cake slice container, in accordance with this invention.
Figure 2:
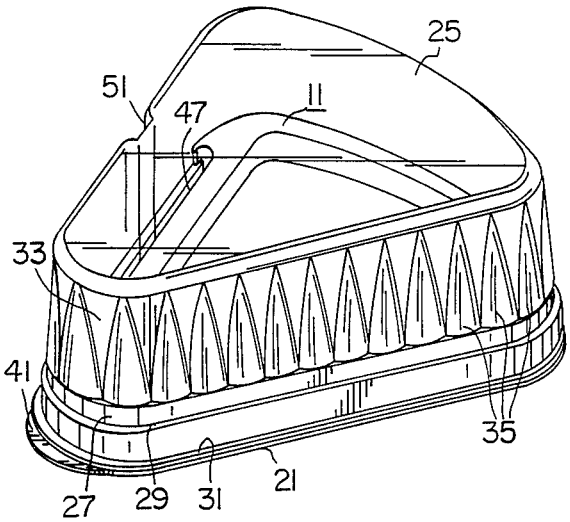
FIG. 2 is a perspective view of the container shown in FIG. 1 but as viewed from the opposite side.

Also located in the base 11 is an inward recess 47 which is sized to accommodate a spoon 49 or other utensil to make a complete package for delivery to the customer. Shown in the upper side wall 33 of cover 23 in FIG. 1 and FIG. 3 is an inwardly projecting rigidifying means 51 which has a lower end 53 extending inwardly over the inward recess 47 on base 11. The inward recess 51 and lower end 53 is aligned to abut a portion of the utensil 49 which is contained in the recess 47. This provides additional stability while making the utensil 49 readily accessible when the top is removed as previously described.

Figure 5:
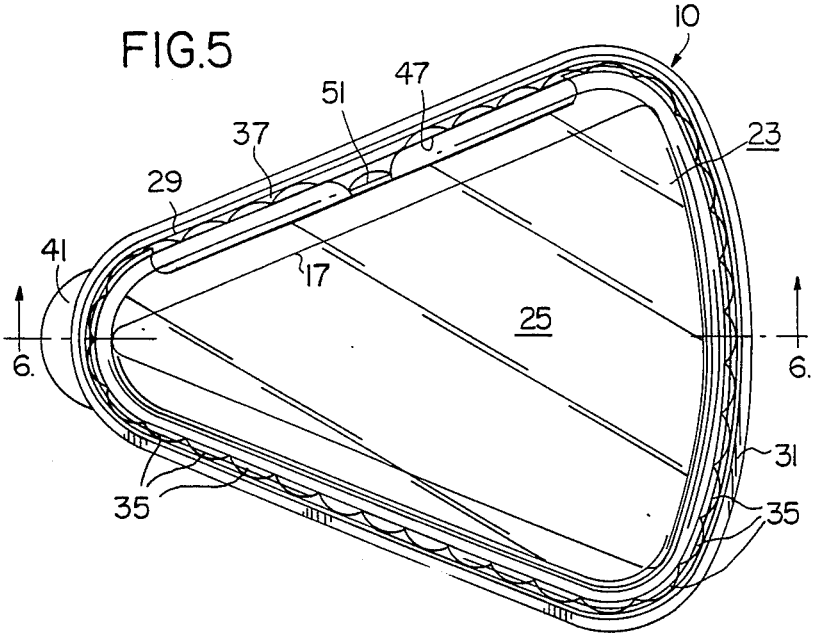
FIG. 5 is a plan view of the container shown in FIG. 4.
Figure 4:
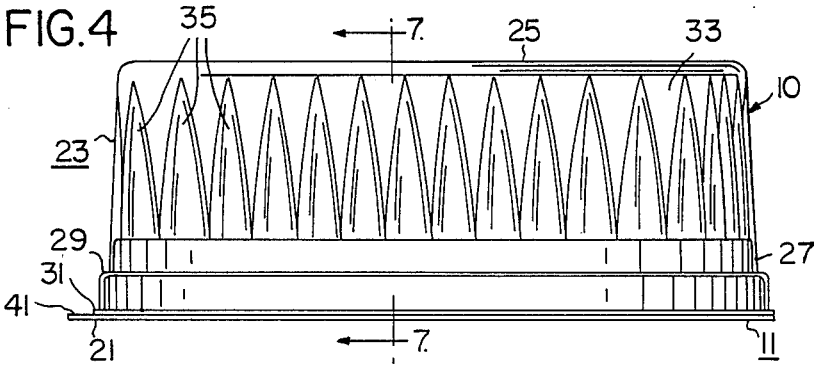
FIG. 4 is a side elevation view of the container shown in FIGS. 1–3.

As is shown in FIG. 4, the side walls 27 have an upper portion 33 where a plurality of rigidifying means 35 are spaced around the entire perimeter of the cover 23. It can be seen in FIG. 5 that the rigidifying means 51 extends out over the inward recess 47 sufficiently to contain the utensil which might be placed in the recess 47.

Figure 6:
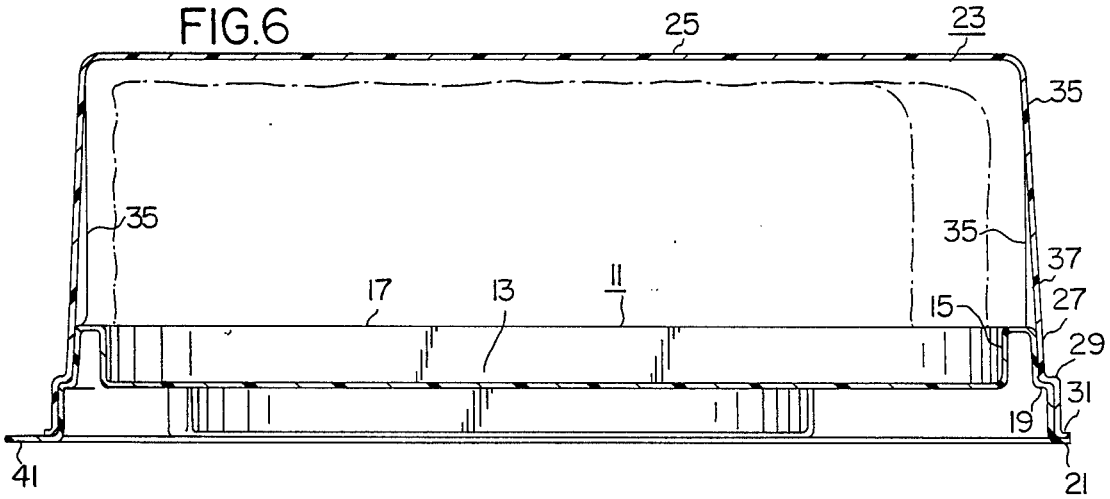
FIG. 6 is an enlarged sectional elevation view of the container taken on the line 6,6 of FIG. 5.
Figure 9:
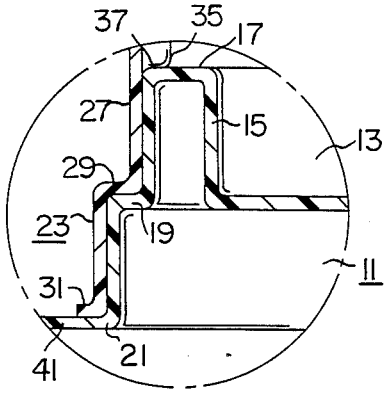
FIG. 9 is a greatly enlarged fragmentary view of the detail contained within the dot and dash of FIG. 6 and designated FIG. 9.

In FIG. 6 and FIG. 9, the close abutting alignment and interface between the first shoulder 19 of base 11 and the first shoulder 29 of cover 23 is shown. Similarly, the terminal edge 21 of base 11 and the terminal edge 31 of cover 23 are seen to be aligned and interfacing. The function of the lower end ledge 37 of the rigidifying means 35 can be seen as the end 37 abuts firmly on the primary shoulder 17. These details are shown in an enlarged view in FIG. 9 as well.

Figure 7:
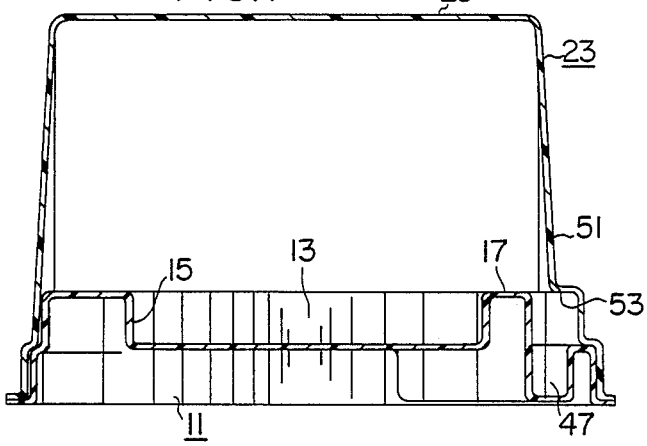
FIG. 7 is an enlarged transverse sectional elevation view taken on the line 7,7 of FIG. 4.

The relationship between the underside 53 of recess 51 and the recess 47 where the utensil 49 is placed is best seen in FIG. 7 which is an enlarged transverse sectional elevational view taken along line 7—7 of FIG. 4.

Figure 8:
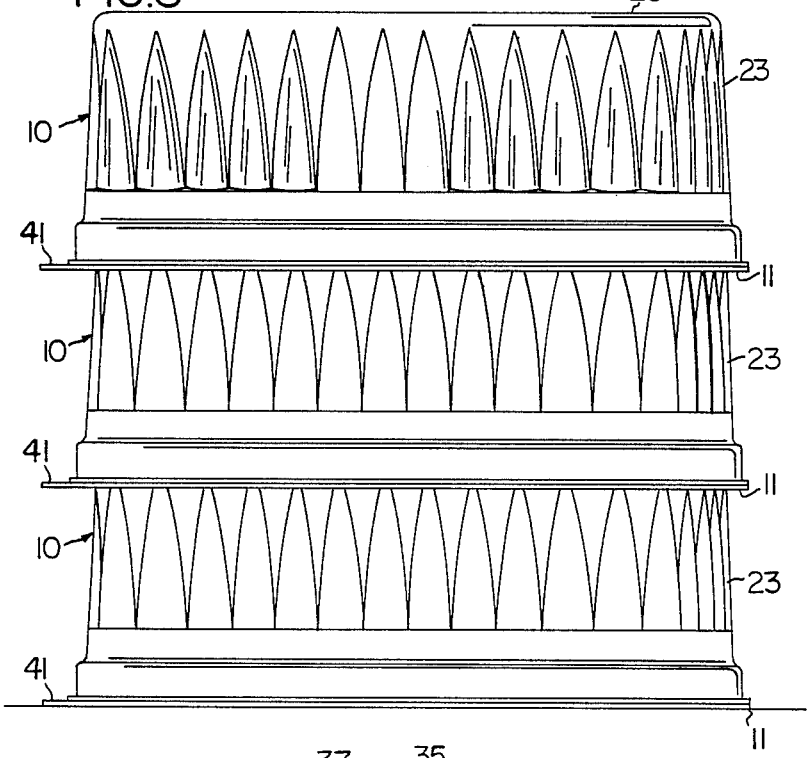
FIG. 8 is a view illustrating containers in a stacked mode.

Finally, in FIG. 8, three containers of this invention are shown in a stack mode where the recessed base members 11 are sized to accept the upper terminal end of the cover 23. Stacking not only provides convenience but stability when large quantities of these containers are shipped from a bakery or other manufacturing or distributing location. The inwardly projecting ledge 37 abuts on the primary shoulder 17 to protect the goods and prevent the cover from being crushed.

Having thus described the invention, what is claimed is:

1. A container assembly for single servings of products comprising a base having side walls extending upwardly from its outer periphery defining a central depression for holding the products, said base side walls including a top peripheral wall generally parallel to the base, means defining an elongated slotted opening in the top peripheral wall of said side wall for a utensil such as a fork or spoon, a cover having a top and side walls of a shape and configuration complementing the base and base side walls, means defining an offset in the cover side wall providing an abutment surface overlying the slotted opening for the utensil to hold the same in place when the cover is applied to the base.

2. A container assembly as claimed in claim 1, wherein said base includes a tab projecting outward from the base side wall beyond the outer edge of the cover side wall to permit gripping by the user for easy separation of said cover from said base.

3. A container assembly as claimed in claim 2, wherein said tab on said base is formed integrally with the terminal edge of said base side wall.

4. A container assembly as claimed in claim 1, wherein the side wall of the cover is of undulating shape defining a plurality of side by side strengthening ribs extending generally transversed to the top.

5. A container assembly as claimed in claim 1, wherein said base includes a recessed underside which is sized to accept the top surface and upper ends of said cover walls, to permit nesting of the container assemblies.

* * * * *